US008253331B2

(12) United States Patent
Somogyvari et al.

(10) Patent No.: US 8,253,331 B2
(45) Date of Patent: Aug. 28, 2012

(54) MERCURY DOSING METHOD FOR FLUORESCENT LAMPS

(75) Inventors: Zoltan Somogyvari, Budapest (HU); Laszlo Balazs, Budapest (HU)

(73) Assignee: General Electric Company, Schenectady, NY (US)

( * ) Notice: Subject to any disclaimer, the term of this patent is extended or adjusted under 35 U.S.C. 154(b) by 162 days.

(21) Appl. No.: 12/768,918

(22) Filed: Apr. 28, 2010

(65) Prior Publication Data

US 2011/0266943 A1 Nov. 3, 2011

(51) Int. Cl.

| | |
|---|---|
| ***H01J 9/04*** | (2006.01) |
| ***H01J 61/67*** | (2006.01) |
| ***H01J 61/28*** | (2006.01) |
| ***H01J 9/38*** | (2006.01) |

(52) U.S. Cl. ..... 313/565; 313/574; 313/564; 313/566; 313/631; 313/638; 313/490; 313/491; 445/38; 445/53

(58) Field of Classification Search ..... 313/631, 313/490, 552

See application file for complete search history.

(56) References Cited

U.S. PATENT DOCUMENTS

| | | | | |
|---|---|---|---|---|
| 2,806,970 | A | 9/1957 | Meister et al. | |
| 3,563,797 | A | 2/1971 | Young et al. | |
| 3,657,589 | A | 4/1972 | Della Porta et al. | |
| 4,182,971 | A | 1/1980 | Cassidy et al. | |
| 5,213,537 | A | 5/1993 | Roberts et al. | |
| 5,520,560 | A | 5/1996 | Schiabel et al. | |
| 5,739,633 | A | 4/1998 | Biro et al. | |
| 5,830,026 | A | 11/1998 | Schiabel et al. | |
| 5,876,205 | A | 3/1999 | Schiabel et al. | |
| 5,880,558 | A * | 3/1999 | Bauer | 313/631 |
| 6,037,714 | A | 3/2000 | Mehrotra et al. | |
| 6,137,225 | A * | 10/2000 | Heuvelmans et al. | 313/580 |
| 6,680,571 | B1 | 1/2004 | Giorgi et al. | |
| 6,774,557 | B2 | 8/2004 | Jansma | |
| 7,378,797 | B2 | 5/2008 | Karrs et al. | |
| 2003/0057814 | A1 * | 3/2003 | Garner | 313/274 |
| 2005/0258756 | A1 * | 11/2005 | Denissen et al. | 313/631 |
| 2009/0032767 | A1 | 2/2009 | Massaro et al. | |
| 2009/0230837 | A1 | 9/2009 | Deme et al. | |

FOREIGN PATENT DOCUMENTS

| | | | |
|---|---|---|---|
| EP | 0 359 724 | B1 | 9/1989 |
| EP | 0 669 639 | A1 | 2/1995 |
| EP | 0 691 670 | B1 | 7/1995 |
| EP | 0 737 995 | B1 | 4/1996 |
| EP | 0 806 053 | B1 | 11/1996 |
| EP | 0 981 826 | B1 | 5/1998 |
| EP | 1 179 216 | B1 | 3/2001 |
| EP | 1 774 566 | B1 | 7/2005 |
| EP | 1 953 800 | A1 | 7/2005 |
| GB | 2 056 490 | A | 7/1980 |

(Continued)

OTHER PUBLICATIONS

Machine English translation of JP05089828 to Misono published Apr. 9, 1993.*

Corazza A et al:"Mercury Dosing in Fluorescent Lamps", Industry Applications Society Annual Meeting, 2008, Piscataway, NJ, USA, Oct. 5, 2008, pp. 1-4, XP031353961.

(Continued)

*Primary Examiner* — Sikha Roy

(74) *Attorney, Agent, or Firm* — Fay Sharpe LLP

(57) ABSTRACT

A fluorescent lamp includes a discharge tube having an inner wall forming a discharge chamber. One or more coiled electrodes are disposed within the discharge tube. A mercury containing composition is disposed on at least one coiled electrode.

24 Claims, 3 Drawing Sheets

FOREIGN PATENT DOCUMENTS

| | | | |
|---|---|---|---|
| JP | 5089828 | A | 4/1993 |
| WO | 97/04477 | A1 | 2/1997 |
| WO | WO 9721239 | A1 | 6/1997 |
| WO | WO 2004/032180 | A2 | 4/2004 |
| WO | WO 2006/075347 | A2 | 7/2006 |
| WO | WO 2006/106551 | A1 | 10/2006 |
| WO | WO 2006106551 | C1 | 10/2006 |
| WO | WO 2008007404 | A2 | 1/2008 |

OTHER PUBLICATIONS

PCT Search Report issued in connection with corresponding WO Patent Application No. US11/31655 filed on Apr. 8, 2011.

Run-Ping Jia et al., Preparation and Optical Properties of $HgWO_4$ Nanorods by Hydrothermal Method Coupled With Ultrasonic Technique, Journal of Nanoparticle Research, 2008, pp. 215-219, DOI 10.1007/s11051-007-9222-x, © Springer 2007.

* cited by examiner

MERCURY DOSING METHOD FOR FLUORESCENT LAMPS

BACKGROUND OF THE DISCLOSURE

The present disclosure relates generally to a low pressure mercury vapor discharge lamp and more particularly to a hot cathode fluorescent lamp including a mercury dosing apparatus and method.

Fluorescent lamps have found widespread acceptability in the market place for a number of applications and are available in a variety of shapes and forms. For example, the lamps may be linear, curvilinear, U-bent or compact in shape as will be familiar to those having ordinary skill in the art. Typically, fluorescent lamps include a light-transmissive glass discharge tube with means, such as electrodes, providing an electric discharge to the interior of the discharge tube. A phosphor layer typically applied to the inner wall surface of the discharge tube comprises the source of the light that the lamp emits. A fill gas and mercury are sealed within the discharge tube and the mercury functions to excite the phosphors' electrons resulting in the production of light by the lamp in a manner familiar to those having ordinary skill in the art.

A known mercury dosing solution for discharge lamps involves adding liquid mercury directly to the discharge tube of the lamp through an exhaust tube having a narrow diameter. Disadvantageously, this approach requires dosing the lamp with an excess of mercury since droplets of mercury can be left in the manufacturing equipment and the exhaust tube.

Other solutions for dosing a discharge lamp involve using capsules filled with liquid mercury which can prevent losses during the manufacturing process. Disadvantageously, the technique to break the capsule to make the mercury available within the lamp is difficult and requires adding machines within the manufacturing process, thereby, presenting increased cost considerations. Still other solutions involve using a metal amalgam in fluorescent lamps. However, amalgam dosing requires special dosing equipment and a means for positioning the amalgam inside the lamp. Another solution involves using solid mercury compounds on metal holders. Disadvantageously, this approach requires additional manufacturing parts, thereby increasing the cost of the lamp.

Furthermore, mercury is a hazardous material so various governmental regulations control the manner in which mercury, including mercury that is contained within articles of commerce such as fluorescent lamps is used. Used or spent lamps containing mercury are disposed of. Consequently, it can be advantageous limit the amount of mercury incorporated into articles that are eventually disposed of.

Thus, a need exists for an improved low pressure mercury vapor discharge lamp having an improved mercury dosing apparatus and method.

SUMMARY OF THE DISCLOSURE

In one aspect, the present disclosure relates to a fluorescent lamp that includes a discharge tube having an interior wall forming a discharge chamber. One or more coiled electrodes are disposed within the discharge chamber. At least one of the coiled electrodes has a mercury containing composition disposed thereon.

In another aspect, the present disclosure relates to a method of mercury dosing on a coiled electrode for a fluorescent lamp that includes providing a discharge tube having one or more coiled electrodes disposed therein and a mercury containing composition disposed onto at least one coiled electrode.

A primary benefit of the present disclosure is the ability to manufacture fluorescent lamps with lower mercury content.

Another benefit of the present disclosure is that dedicated, additional lamp parts may not be required.

Yet another benefit of the present disclosure is minimal, if any, modification to the manufacturing process of the lamps.

Yet another benefit of the present disclosure is that the cost of the lamp may be reduced due to the elimination of mercury dispensers.

Still further advantages will become apparent to those of ordinary skill in the art upon reading and understanding the following detailed description of the preferred embodiment.

DETAILED DESCRIPTION OF THE PREFERRED EMBODIMENTS

The current inventive mercury dosing apparatus and method for fluorescent lamps provides for more precisely dosing mercury at a very low level without the use of additional dedicated lamp parts, without, if any, modifications in the manufacturing process and without undergoing decomposition of the mercury containing composition which may occur at higher processing temperatures. This is achieved in the inventive system disclosed herein by disposing a mercury-containing composition in some combination with an electron emissive composition onto the surface of the electrode assembly included in the lamp and preferably on a coiled electrode. The electron emission mix is applied to the electrodes and typically is a mixture of barium, strontium, and calcium carbonates. A carbonate electron emissive composition requires a decomposition step of heating to about 1200° C. to form its desired active oxide prior to disposing the mercury containing composition onto the coiled electrode. The decomposition is accomplished using a resistive heating which is the passage of an electric current through the electrodes. During the decomposition of the carbonate electron emissive composition, carbon dioxide is formed. The carbon dioxide is removed from the lamp interior by continuously exhausting the lamp through the exhaust tube. By choosing an air stable electron emissive composition, the decomposition step can be eliminated.

Figure 1:
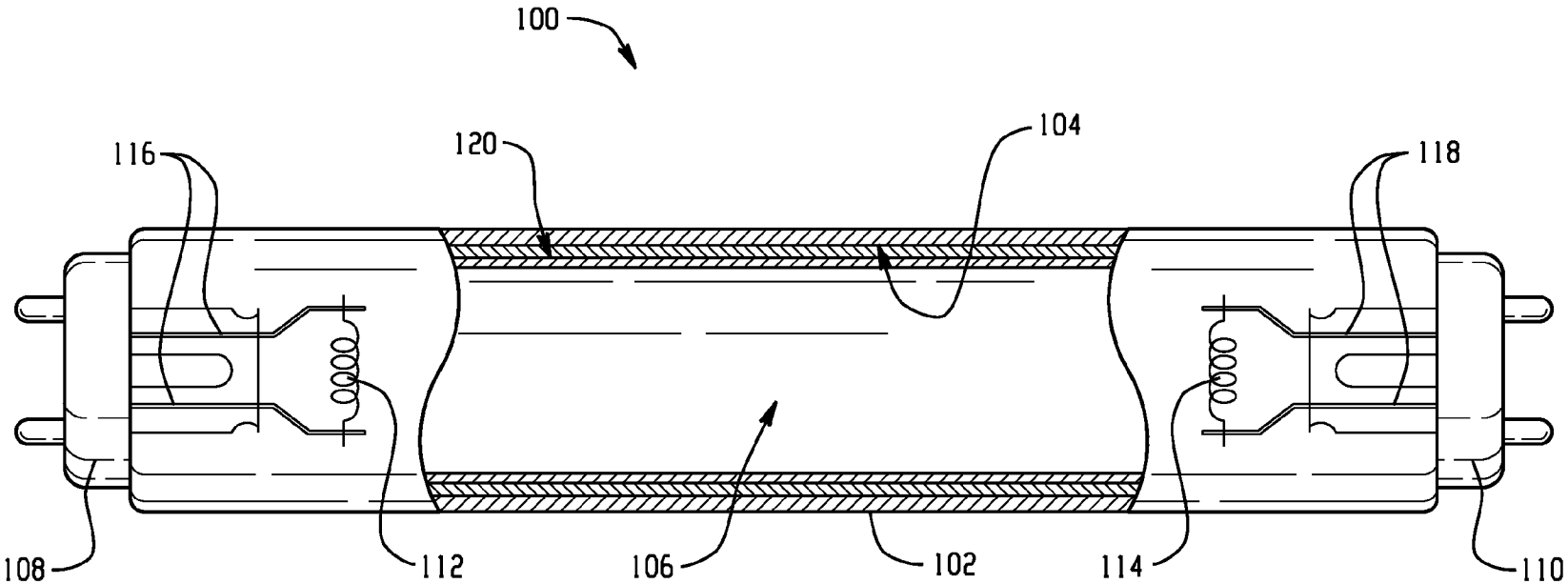
FIG. 1 is across-sectional view of a conventional fluorescent lamp.

FIG. 1 illustrates a fluorescent lamp 100. The lamp 100 includes a sealed discharge tube or a light transmissive envelope 102, preferably formed of a material which is transmissive to radiation in the visible range and may also be transmissive to radiation in the IR range. Suitable materials for forming the envelope 102 include transparent materials such as soda-lime glass, and other vitreous materials, although translucent materials, such as ceramic materials, are also contemplated. The lamp has a discharge chamber 106. As illustrated in FIG. 1, the discharge tube 102 is a single tube with substantially straight ends or end sections 108, 110. At the ends 108, 110 of a discharge tube path, the tube is provided with electrodes 112, 114 and lead-in wires 116, 118 connected to the electrodes. The electrodes 112, 114 have a coiled shape. However, other configurations may prove suitable as is known in the art. The lead-in wires of the discharge tube are connected to a ballast unit (not shown) for controlling the current in the discharge tubes.

Known fluorescent lamp configurations, such as straight, u-shaped, spiral, and configurations including multiple tubes, connected to allow a continuous arc path where necessary, among others are suitable for application of the inventive mercury dosing method disclosed in the application.

In order to provide visible light, an internal surface of the discharge tube is covered with a fluorescent phosphor layer 120. This phosphor layer 120 is within the sealed discharge volume. The composition of such a phosphor layer 120 is known per se. This phosphor layer 120 converts the short wave, mainly UVC radiation into longer wave radiation in the spectrum of visible light. The phosphor layer 120 is applied to the inner surface of the discharge tube before the tube is sealed.

A discharge fill gas is contained within the discharge chamber 106. The fill gas typically includes a noble gas such as argon or a mixture of argon and other noble gases such as xenon, krypton, or neon and is responsible for the arc voltage, that is, the fill gas parameters determine the mean free path of the electrons. Because the noble gases have only an indirect, small influence on the mercury vapor pressure of the lamp 100, the gas fill is not a critical feature of the invention.

The operation of fluorescent lamps, such as in the present disclosure, requires the presence of mercury which can be disposed within the interior of the discharge chamber 106 during the manufacture of the lamp. As can be appreciated by those skilled in the art, the mercury atoms, excited by the electrons in the discharge, will emit ultraviolet photons which in turn excite the phosphor layer 120 resulting in the production of light that is transmitted through the discharge chamber 106.

The amount of mercury inserted into the discharge chamber 106 of a fluorescent lamp is a function of a number of variables including, among other considerations, the size of the lamp. The amount of mercury employed should be sufficient to provide a saturated mercury vapor pressure within the lamp throughout substantially the entire life of the fluorescent lamp. One skilled in the art would know how much mercury must be used at a minimum to operate the lamp. The present inventive system is directed to reducing the amount of mercury disposed to a level lower than that of the currently commercially available lamps. With that in mind, the present inventive system provides a more exact amount of mercury, in the form of a deposited coating, whether coated directly on the electrode surface, coated over the emission composition on the electrode surface, or as part of a composite mixture coated directly to the electrode surface. Because the amount needed is specific to lamp design (size, power, phosphors etc.), one skilled in the art, would be able to calculate the amount needed to support lamp life and limit the Hg dose to that amount, without having to include additional Hg to compensate for process deviations.

Coating the electrodes in a fluorescent lamp with an electron emissive composition ("emission mix") is well known. An emission mix on the discharge tube electrodes is required to enable electrons to pass into the gas via thermionic emission at the tube operating voltages used. In an exemplary embodiment, the electron emissive composition is an air-stable composition selected from the group consisting of $Ba_2CaWO_6$, $Ba_4T_2O_9$, $Ba_5Ta_4O_{15}$, $BaY_2O_4$, $BaCeO_2$, $Ba_xSr_{1-x}Y_2P_4$, $Ba_2TiO_4$, $BaZrO_3$, $BaxSr_{1-x},TiO_3$, $Ba_xSr_{1-x}ZrO_3$, wherein x=0 to 1, barium, strontium, calcium, oxides thereof, and mixtures thereof with one or more of the metals form the series comprising tantalum, titanium, zirconium, and/or with one or more of several rare earth such as scandium, yttrium, and lanthanum.

The electron emission composition can be characterized by its heat treatment temperature ($T_e$) required to "activate" the electrode. In an exemplary embodiment, the heat treatment temperature ($T_e$) for the electron emissive composition is less than about 900° C.

The mercury containing composition can be characterized by the decomposition temperature ($T_m$). The decomposition temperature of a composition is the temperature at which the substance decomposes into smaller substances or into its constituent atoms. Thus, the mercury containing composition should be a mercury compound stable at manufacturing process temperatures which are generally greater than about 500° C., in order to prevent risk of mercury loss due to decomposition. The mercury containing composition is selected from the group consisting of $HgWO_4$ (mercury (II)-tungstate), $HgMoO_4$ (mercury (II)-molybdate), $HgSb_2O_4$ (mercury (II)-antimonite), $HgZrO_4$ (mercury (II)-zirconate), $HgTiO_3$ (mercury (II)-titanate), $HgSiO_3$ (mercury(II)-silicate), $Hg_2P_2O_7$ (mercury (II)-pyrophosphate), $HgAl_2O_4$ (mercury (II)-aluminate), $Hg_2Nb_2O_7$ (mercury (II)-niobate), $Hg_2Ta_2O_7$ (mercury(II)-thallate), and titanium, zirconium, copper, aluminum, palladium, lanthanum, cerium, praseodymium, neodymium, samarium, europium, gadolinium, terbium, dysprosium, holmium, erbium, thulium, ytterbium, lutetium, scandium, hafnium, amalgams thereof, and combinations thereof. The foregoing compounds and amalgams may require the presence of reducing materials such as, aluminum, silicon and zirconium. In an exemplary embodiment, the decomposition temperature ($T_m$) for the mercury containing composition is generally greater than about 500° C.

In an exemplary embodiment, the electrode activation temperature $T_e$ is lower than the decomposition temperature $T_m$ of the mercury containing composition, wherein $T_e<T_m$.

Figure 2:
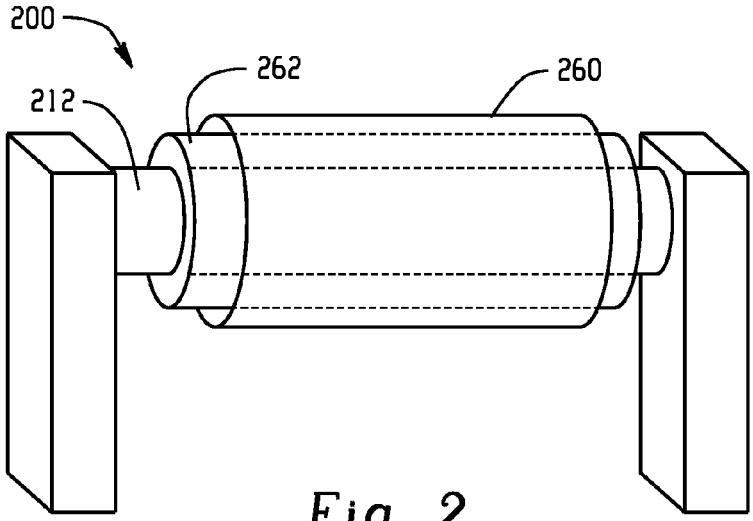
FIGS. 2-4 are schematic perspective views of a coiled electrode including a mercury containing composition in accordance with an exemplary embodiment.
Figure 3:
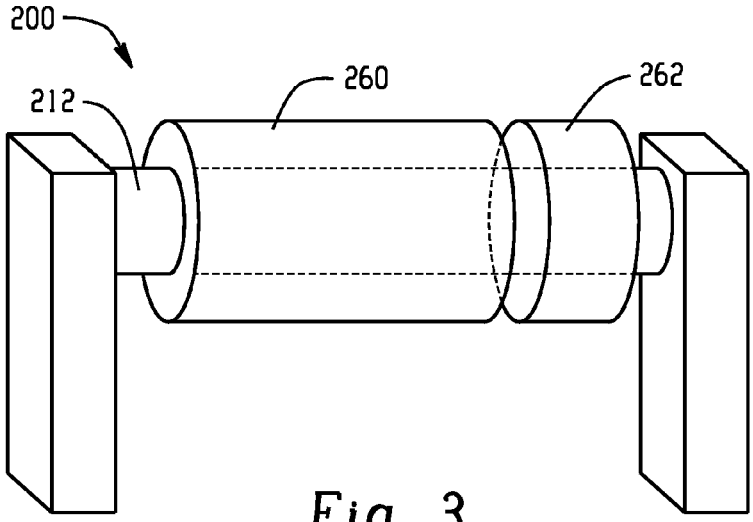
Figure 4:
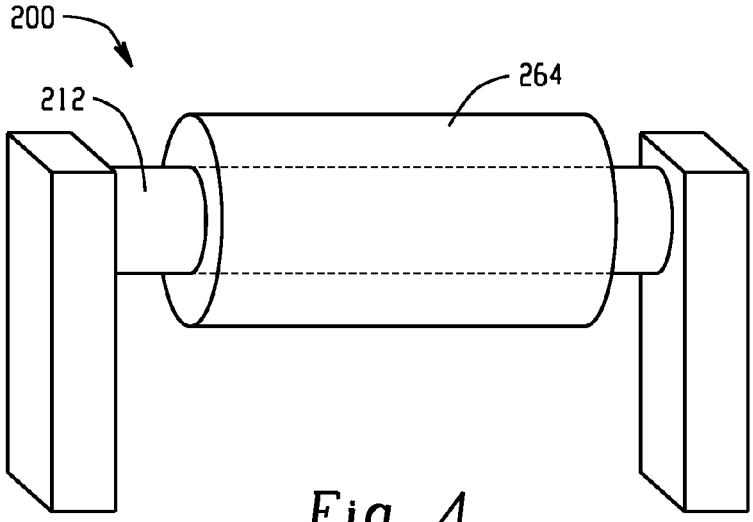

With regard to FIGS. 2-4, a schematic perspective view of a coiled electrode 200 is shown. In this exemplary embodiment, a mercury containing composition disposed on a coiled electrode 112, shown to be straight for purposes of illustrating the mercury containing composition coating, is provided. The coiled electrode(s) 112 may be formed from an electrically conductive material, such as tungsten. Although, it may be appreciated other suitable conductive materials may be used without departing from the scope and intent of the present disclosure.

In FIG. 2, the mercury containing composition 260 is disposed on an electron emissive composition 262 which is directly disposed on the coiled electrode 212. In FIG. 3, the mercury containing composition 260 is positioned directly adjacent to, rather than over, the electron emissive composition layer 262 such that the mercury layer is disposed directly onto the surface of the coiled electrode 212. In FIG. 4, a composite composition is disposed on the coiled electrode. The coiled electrode is coated with a composition formed by mixing an electron emissive composition and a mercury containing composition, thus requiring only one electrode coating step. In an embodiment, the mercury containing composition is $HgWO_4$ and the electron emissive composition is $Ba_2CaWO_6$ In another embodiment, the mercury composition is at least one of a $HgWO_4$ (mercury (II)-tungstate), a $HgZrO_4$ (mercury (II)-zirconate), or a $HgTiO_3$ (mercury (II)-titanate), and the electron emissive composition is at least one of a barium, strontium, calcium, oxides thereof, and mixtures thereof, a $Ba_2CaWO_6$ or a barium, strontium, calcium, zirconates thereof, and mixtures thereof The various combinations of the mercury containing composition and electron emissive composition disposed on the electrodes may be set to dose or provide free mercury in vapor form. The mercury containing composition is set to dose an amount of mercury, for example, from about 0.1 mg to about 5.0 mg, i.e. from about 0.2 to about 3.0 mg. In one embodiment, the mercury containing composition is set to dose an amount of mercury greater than about 0.3 mg. In another embodiment, the mercury containing composition is set to dose an amount of mercury less than about 1.0 mg.

Without intending to limit the scope of the disclosure, the following example demonstrates the formation of fluorescent lamps with an improved mercury dosing method.

EXAMPLES

Materials

Mercury (II) chloride, sodium tungstate, (barium, strontium, and calcium carbonates), zirconium oxide $(Zr)_2$), barium calcium tungsten oxide ($Ba_2CaWO_6$), butyl acetate, absolute ethanol were purchased from Sigma-Aldrich® Company. All materials were reagent grade and used without further purification.

Preparation of a Mercury Tungsten Oxide ($HgWO_4$)

Mercury tungsten oxide was prepared using a method according to Run-Ping Jia, et al., Preparation and Optical Properties of HgWO4 Nanorods by Hydrothermal Method Coupled with Ultrasonic Technique, Journal of Nanoparticle Research, 2008, Volume 10, pages 215-219. Sodium tungstate ($Na_2WO_4$) 0.025 moles (7.35 grams) and mercury (II) chloride powders were mixed in a glass ampoule. 25 milliliters of distilled water was added to dissolve the mixture and the ampoule was sealed. The mixture was treated by heating for two hours at 180° C. thereby obtaining a brownish-reddish precipitate. The reaction mixture was then filtered at room temperature and washed three times with distilled water followed by absolute ethanol. While the foregoing method was used in the following examples, other methods may be employed as the method of generating the mercury compound.

Preparation of a Mercury Dosed Coiled Electrode (FIGS. 2-4)

Example 1

While a coiled electrode 200 in keeping with FIG. 2 is used in the following examples, it is to be understood that the coiled configuration has no critical bearing on the placement or function of the mercury and/or emission coatings. FIG. 2 is used to show the mercury containing composition disposed over the electron emission composition layer. In this example, a carbonate electron emissive composition is initially prepared. The coiled electrode is coated with a carbonate compound of barium, strontium, or calcium and up to about 5% of a zirconium oxide ($ZrO_2$) additive to form the carbonate electron emissive composition layer. The constituents of the electron emissive material are suspended in butyl-acetate. A small amount is nitrocellulose (typically 1 m/m% of the electron emissive material) is also added to the suspension to ensure proper adhesion of the electron emissive material to the coil. The coated, coiled electrode is heated to about 1200° C. in order to decompose the carbonate composition into its active oxide phase and carbon dioxide. The decomposition is performed in a water and carbon dioxide free environment. After cooling down under 500° C. the coated coiled electrode is then coated with a mercury containing composition, such as mercury tungsten oxide ($HgWO_4$), to form an additional layer on the electrode. Any suitable mercury containing composition as disclosed herein or known in the relevant field of technology may be applied in a similar manner as for Examples 1-4. The coated electrode is sealed into the chamber. During the sealing process the temperature of the coated electrode remained below 500° C. Current is passed through the coated electrode to heat up to about 300° C. but not higher than 500° C. to remove binder and impurities, like carbon-dioxide, nitrogen, etc. The discharge chamber of the lamp is filled with noble gases through an exhaust tube and the lamp is closed (tip-off) as is well known in the art. Resistive heating is applied to the coated coiled electrode in order to heat the electrode above the decomposition temperature of the mercury dosing compound to release free mercury within the chamber. In another embodiment, the coiled electrode can be coated with an air stable electron emission composition in order to eliminate the carbonate decomposition step of heating to about 1200° C.

Example 2

While a coiled electrode 200 in keeping with FIG. 3 is used in the following example, it is to be understood that the coiled configuration has no critical bearing on the placement or function of the mercury and/or emission coatings. In FIG. 3 the mercury containing composition coating is disposed adjacent the electron emission composition coating and directly on the electrode coil. In this example, the coiled electrode is coated with a carbonate electron emission composition as described in Example 1. The coated coiled electrode is heated to about 1200° C. in order to decompose the mixture into its active oxide phase and carbon dioxide as described in Example 1. The coated coiled electrode is then coated directly with a mercury-containing composition, such as mercury tungsten oxide ($HgWO_4$), disposed adjacent the carbonate emission composition. The coated electrode is sealed into the chamber. During the sealing process the temperature of the coated electrode remained below 500° C. Current is passed through the coated electrode to heat up to about 300° C. but not higher than 500° C. to remove impurities, like carbon-dioxide, nitrogen, etc. The discharge chamber of the lamp is filled with noble gases through an exhaust tube and the lamp is closed (tip-off) as is well known in the art. Resistive heating is applied to the coated, coiled electrode in order to heat the electrode above the decomposition temperature of the mercury dosing compound to release free mercury within the chamber. In another embodiment, the coiled electrode can be coated with an air stable electron emission composition in order to eliminate the carbonate decomposition step of heating to about 1200° C.

Example 3

While a coiled electrode 200 in keeping with FIG. 4 is used in the following example, it is to be understood that the coiled configuration has not critical bearing on the placement or function of the mercury and/or emission coatings. In FIG. 4, the coiled electrode is coated with a composition formed by mixing an air stable electron emissive composition and a mercury containing composition, thus requiring the deposition of only one mercury dosing layer. Fine powders of mercury tungsten oxide and barium calcium tungsten oxide, an air-stable electron emissive composition, were mixed in a mass ratio of 14:86, respectively. The resulting mixture was suspended in butyl acetate. The coiled electrode was then coated with the formed composition. The coated electrode is sealed into the chamber. During the sealing process the temperature of the coated electrode remained below 500° C. Current is passed through the the coated electrode to heat up to about 300° C. not higher than 500° C. to remove impurities, like carbon-dioxide, nitrogen, etc The discharge chamber of the lamp was filled with noble gases through an exhaust tube and the lamp was closed (tip-off) as is well known in the art. Resistive heating was applied to the coated, coiled electrode in order to heat the electrode above the decomposition temperature of the mercury dosing compound to release free mercury within the chamber.

Analysis

Figure 5:
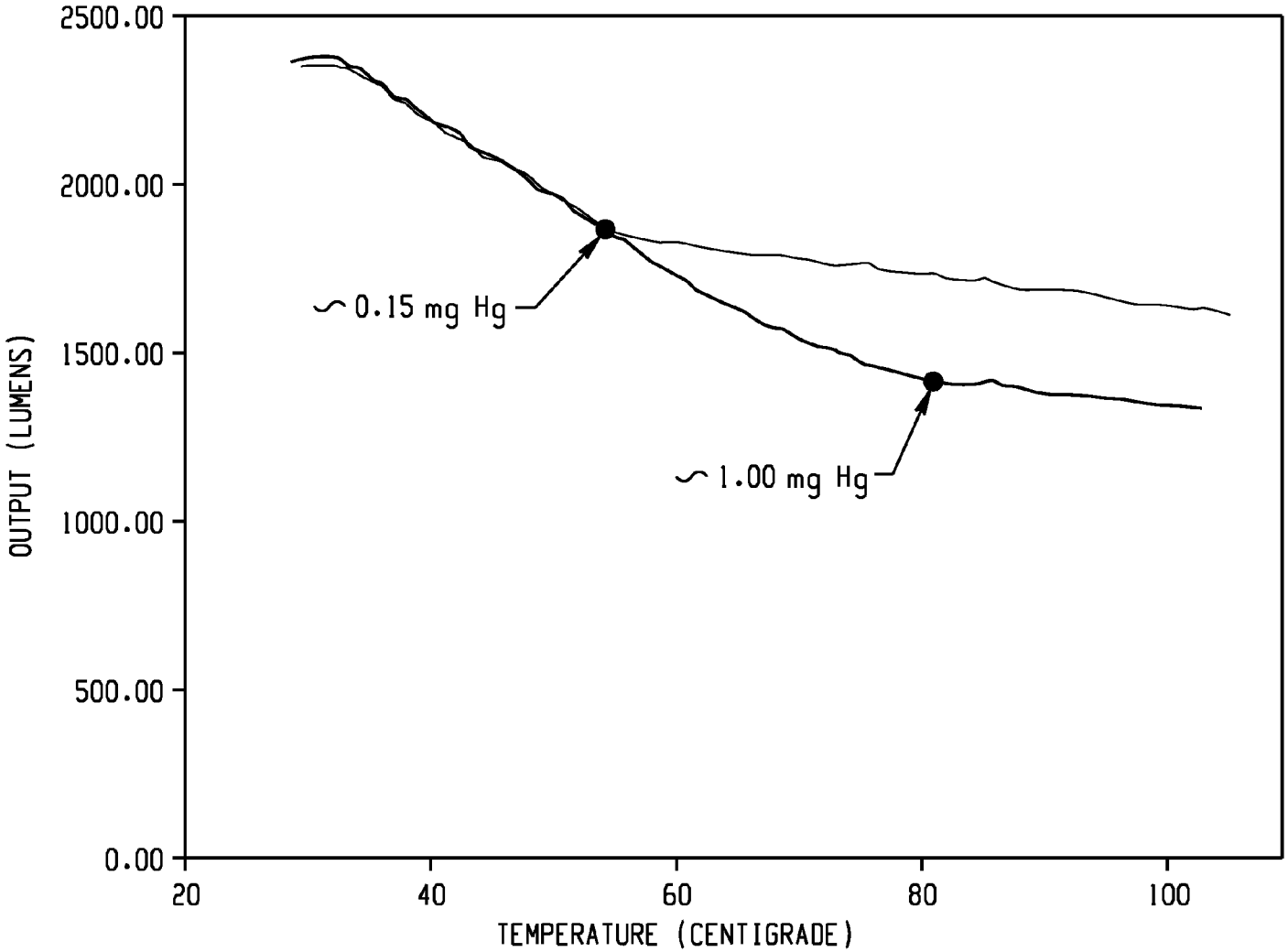
FIG. 5 is a plot of lumen output versus temperature for a composite mixture of $Ba_2CaWO_4$+$HgWO_4$ coated electrode according to an exemplary embodiment.

FIG. 5 is a plot of lumen output versus temperature for a composite mixture of $Ba_2CaWO_6$+$HgWO_4$ coated on an electrode according to the method given in Example 3. The plot illustrates that the free mercury content for lamps can be calculated from the break-point of the light-output temperature dependence, that is, where all the free mercury is already in the vapor form. In the case of a General Electric F32 T8 4' lamp equipped with electrode coated structures as described above in Example 3, about 1 mg of mercury vapor is formed within the discharge tube at about 80° C. The lumen output versus temperature curve of the $HgWO_4$ dosed lamp shows approximately the whole amount of dosed mercury, i.e., 1 mg, is available for use during the discharge process or during lamp operation. A sustained mercury vapor of about 1 mg, as previously described, must be maintained within the lamp. The reference curve (dotted line) is taken from a liquid dosed lamp containg approximatey 0.15 mg Hg. The lumen output versus temperature of the $HgWO_4$ dosed lamp as formed in Example 3 closely resembles the liquid mercury dosed lamp observed at room temperature to 55° C. range.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A hot cathode fluorescent lamp comprising:

a discharge tube having an interior wall forming a discharge chamber; and one or more coiled electrodes disposed within the discharge chamber, wherein at least one coiled electrode has a mercury containing composition disposed on its surface; and a means for providing heat necessary for the decomposition of the mercury containing composition during lamp operation.

2. The lamp of claim 1 wherein the coiled electrodes further have an electron emissive composition disposed thereon.

3. The lamp of claim 2, wherein the mercury containing composition is disposed over the electron emissive composition.

4. The lamp of claim 2 wherein the mercury containing composition has a decomposition temperature ($T_m$) and the electron emissive composition has a heat treatment temperature ($T_e$).

5. The lamp of claim 4, wherein $T_e<T_m$.

6. The lamp of claim 4 wherein $T_m$ is greater than about 500° C. and $T_e$ is less than about 900° C.

7. The lamp of claim 2 wherein the electron emissive composition is an air stable composition selected from the group consisting of $Ba_2CaWO_6$, $Ba_4T_2O_9$, $Ba_5Ta_4O_{15}$, $BaY_2O_4$, $BaCeO_2$, $Ba_xSr_{1-x}Y_2O_4$, $Ba_2TiO_4$, $BaZrO_3$, $BaxSr_{1-x}TiO_2$, $Ba_xSr_{1-x}ZrO_3$, wherein x=0 to 1, and a carbonate composition of barium, strontium, or calcium.

8. The lamp of claim 2 wherein the mercury containing composition is disposed adjacent the electron emissive composition.

9. The lamp of claim 2 wherein the mercury containing composition is disposed on a first surface of the coiled electrode and the electron emissive composition is disposed on a second surface of the coiled electrode.

10. The lamp of claim 2 wherein the mercury containing composition is a composite material including the electron emissive composition and is disposed on a surface of the coiled electrode.

11. The lamp of claim 10 wherein the mercury composition comprises at least one of a $HgWO_4$ (mercury (II)-tungstate), a $HgZrO_4$ (mercury (II)-zirconate), or a $HgTiO_3$ (mercury (II)-titanate), and the electron emissive composition comprises at least one of a barium, strontium, or calcium oxide, and mixtures thereof, a $Ba_2CaWO_6$, and a barium, strontium, or calcium zirconate and mixtures thereof.

12. The lamp of claim 1 wherein the mercury containing composition is selected from the group consisting of $HgWO_4$ (mercury (II)-tungstate), $HgMoO_4$ (mercury (II)-molybdate), $HgSb_2O_4$ (mercury (II)-antimonite), $HgZrO_4$ (mercury (II)-zirconate), $HgTiO_3$ (mercury (II)-titanate), $HgSiO_3$ (mercury (II)-silicate), $Hg_2P_2O_7$ (mercury (II)-pyrophosphate), $HgAl_2O_4$ (mercury (II)-aluminate), $Hg_2Nb_2O_7$ (mercury (II)-niobate), $Hg_2Ta_2O_7$ (mercury(II)-thallate), and amalgams of titanium, zirconium, copper, aluminum, palladium, lanthanum, cerium, praseodymium, neodymium, samarium, europium, gadolinium, terbium, dysprosium, holmium, erbium, thulium, ytterbium, lutetium, scandium, hafnium, and combinations thereof.

13. The lamp of claim 1 wherein the mercury containing composition comprises $HgWO_4$.

14. The lamp of claim 1 wherein the mercury containing composition is set to dose a mercury amount from about 0.3 mg to about 1.0 mg.

15. A method of mercury dosing on a coiled electrode for a hot cathode fluorescent lamp comprising:

providing a discharge tube having one or more coiled electrodes disposed therein; and disposing a mercury containing composition onto at least one coiled electrode, wherein during operation the one or more electrodes emit heat necessary for the decomposition of the mercury containing composition.

16. The method of claim 15 further comprising disposing an electron emissive composition on the coiled electrode.

17. The method of claim 16 wherein the mercury containing composition is disposed over the electron emissive composition.

18. The method of claim 16 wherein the mercury containing composition is disposed directly onto the coiled electrode adjacent the electron emissive composition.

19. The method of claim 16 wherein a composite composition is disposed on the coiled electrode, the composite composition comprising at least the mercury containing composition and the electron emissive composition.

20. The method of claim 19 wherein the composite material comprises $HgWO_4$ and the electron emissive composition comprises $Ba_2CaWO_6$.

21. A hot cathode fluorescent lamp comprising:

a discharge tube having an interior wall forming a discharge chamber;

one or more coiled electrodes disposed within the discharge tube, at least one coiled electrode having disposed on its surface a mercury containing composition having a decomposition temperature ($T_m$), and an elec tron emissive composition having a heat treatment temperature ($T_e$), and wherein $T_e<T_m$; and a means for providing the heat necessary for decomposition of the mercury containing composition during lamp operation.

22. The lamp of claim 21 wherein $T_m$ is greater than about 500° C. and $T_e$ is less than about 900° C.

23. The lamp of claim 21 wherein the mercury composition comprises $HgWO_4$ and the electron emissive composition comprises $Ba_2CaWO_6$.

24. The lamp of claim 21 wherein a mercury dose amount is from about 0.03 mg to about 1 mg.

* * * * *